United States Patent [19]

Kiziah

[11] Patent Number: 4,694,513

[45] Date of Patent: Sep. 22, 1987

[54] DRAIN

[76] Inventor: Floyd G. Kiziah, 501 N. 44th Ave., Hollywood, Fla. 33021

[21] Appl. No.: 6,019

[22] Filed: Jan. 22, 1987

[51] Int. Cl.[4] ..... E03C 1/26

[52] U.S. Cl. ..... 4/288; 4/613; 285/4; 285/158

[58] Field of Search ..... 4/286, 288, 613, 650, 4/652; 285/4, 302, 192, 189, 158; 52/302

[56] References Cited

U.S. PATENT DOCUMENTS

| | | | |
|---|---|---|---|
| 2,299,705 | 10/1942 | Suirsky | 4/613 |
| 3,742,525 | 4/1973 | Oropallo | 4/288 |
| 4,067,072 | 1/1978 | Izzi | 4/288 |
| 4,092,745 | 6/1978 | Oropallo | 4/288 |
| 4,146,939 | 4/1979 | Izzi | 4/286 |
| 4,261,598 | 4/1981 | Cornwall | 285/3 |
| 4,505,814 | 3/1985 | Marshall | 210/166 |

*Primary Examiner*—Henry J. Recla
*Assistant Examiner*—Linda J. Sholl
*Attorney, Agent, or Firm*—Oltman and Flynn

[57] ABSTRACT

A drain for a tile-covered concrete floor over a plywood form base. The drain has an annular internally screw-threaded base member with a bottom flange that can be nailed or screwed to the form base, an annular body member threadedly received in the base member and having its lower end fitting with a drain pipe, a membrane and a dished membrane retainer overlying a top flange on the body member, a clamping ring screwed onto the outside of the upper end of the body member above the membrane retainer, and an annular strainer support screwed into the upper end of the body member and providing a seat for a strainer plate.

9 Claims, 11 Drawing Figures

DRAIN

SUMMARY OF THE INVENTION

This invention relates to a floor drain, particularly for a shower.

A principal feature of the present invention is its adaptability to different floor thicknesses, particularly concrete floors employing the use of a plywood form base, allowing the drain assembly to be permanently placed and adjusted to different concrete thickness prior to pouring of concrete and covered by tile or other floor surface material. Typically, concrete floors, such as for showers, may vary by several inches in thickness from one building to another. To avoid the necessity of stocking different sizes of drains for different floor thicknesses the present invention provides an extensive range of vertical adjustability in the drain, so that the same drain can be used with any floor thickness likely to be encountered.

It is, therefore, a principal object of this invention to provide a floor drain of novel construction providing an extensive range of adjustment to concrete floors of different thicknesses.

Further objects and advantages of this invention will be apparent from the following detailed description of a presently preferred embodiment which is illustrated schematically in the accompanying drawings.

Preferably, the drain of the present invention has an annular base member, which can be nailed to a plywood form base before the concrete floor is poured, and an annular body member screw-threadedly engaging the base member and adjustable vertically several inches up or down along the base member. The body member has a horizontal annular flange at the top for receiving a waterproof membrane which is held down by a clamping retainer.

The body member has a central, annular, upper projection at the top which is screw-threaded both externally and internally. A clamping ring above the membrane retainer threadedly engages the external screw threads on this projection to clamp the membrane against the top of the body member. A strainer support threadedly engages the internal screw threads on the upper projection. This strainer support has a transverse annular flange which overlies the clamping ring and provides an upwardly-facing seat for a strainer.

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

DETAILED DESCRIPTION

Figure 1:
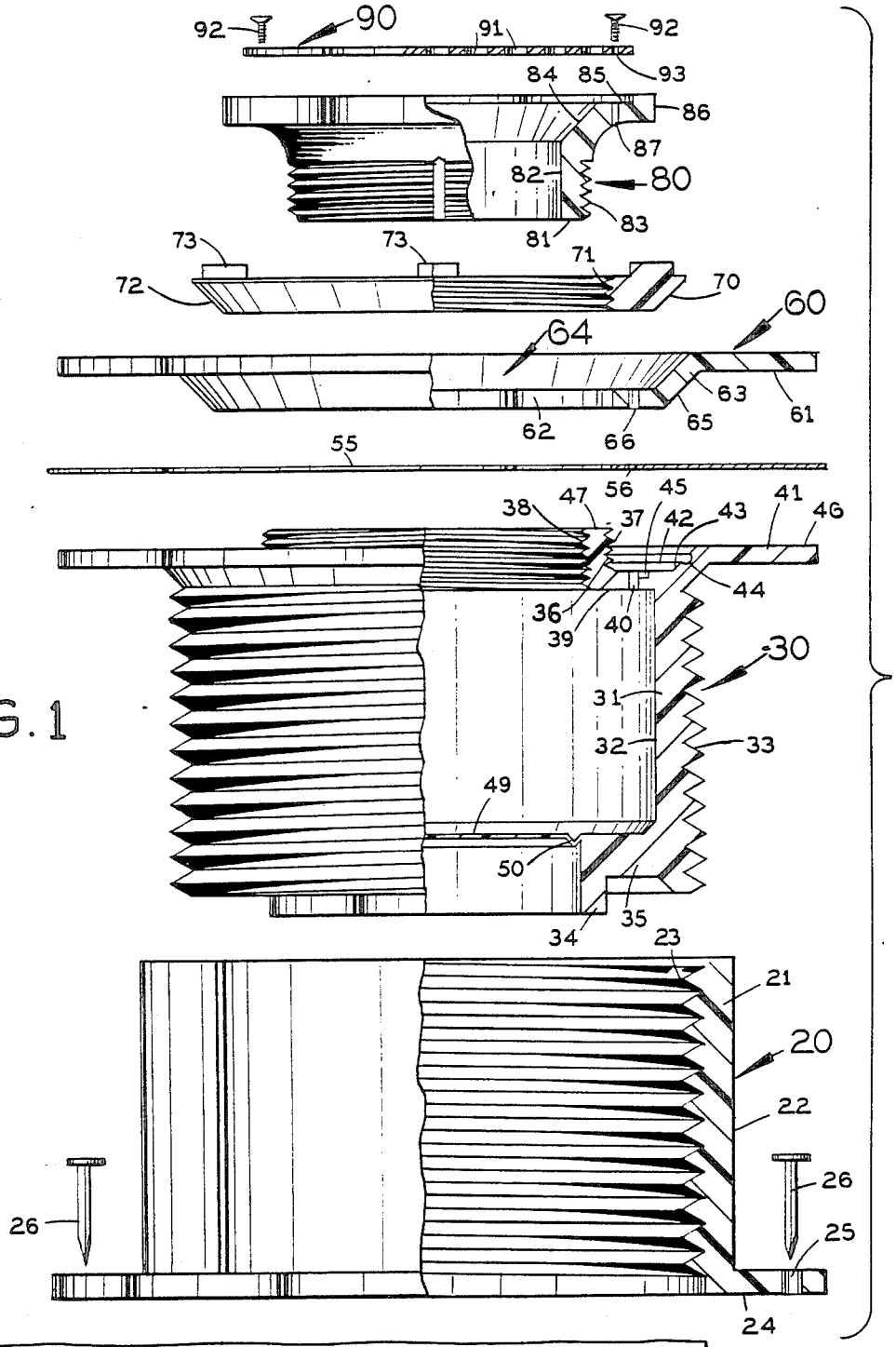
FIG. 1 is an exploded elevational view of the present drain with parts broken away for clarity.
Figure 2:
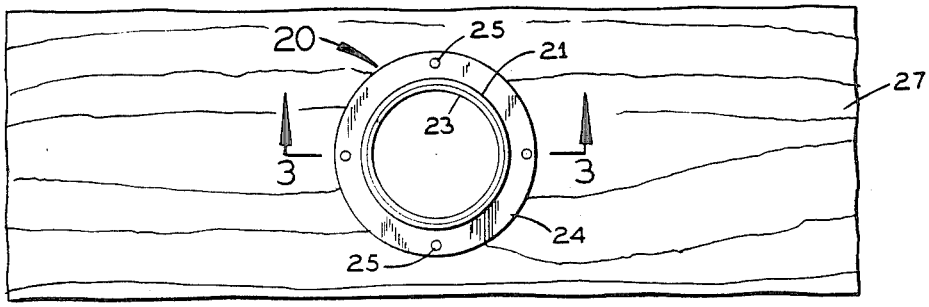
FIG. 2 is a top plan view of the base member of this drain secured to a plywood or similar concrete form base.

Referring first to FIG. 1, in broad outline the floor drain of the present invention has a base member 20, a body member 30, an applied waterproof membrane 55, a membrane retainer 60, a ring 70, a strainer holder 80 and a strainer plate 90.

Figure 3:
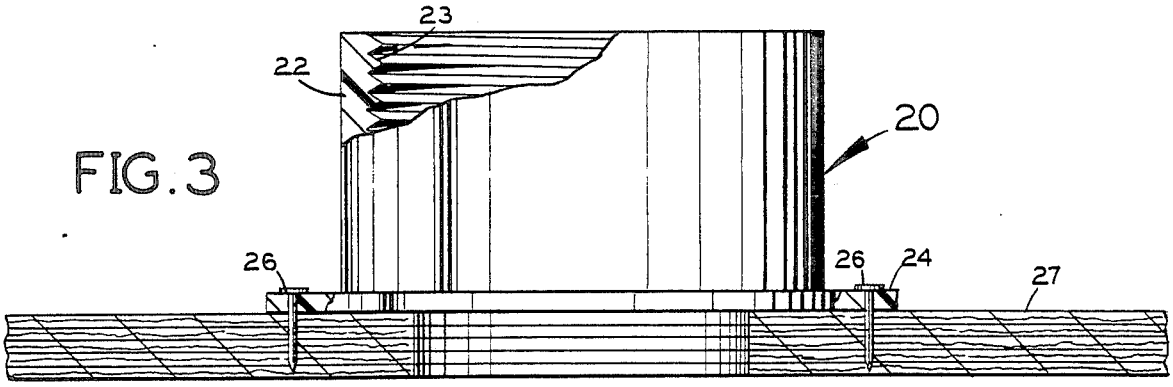
FIG. 3 is an elevation of the base member of the drain on the form base, with part of the base member broken open at the top.

The base member 20 has an upstanding annular segment 21 with a cylindrical outside surface 22 and a screw-threaded inside surface 23. At its lower end the base member has a horizontally outwardly-projecting annular flange 24 with openings 25 for receiving nails or screws 26 to mount the base member 20 on top of a plywood form base 27, as shown in FIG. 3. In one practical embodiment the height of the screw-threaded inside of the base member is about 3 inches.

The body member 30 has an upstanding annular wall 31 with a cylindrical inside surface 32 and a screw-threaded inside surface 23 of base member 20. At its lower end the body member has a cylindrical projection 34 with smooth outside and inside surfaces, both of smaller diameter than the inside diameter of annular wall 31. The cylindrical lower projection is connected to the lower end of the annular wall 31 by an annular bottom wall segment 35 extending horizontally between them.

At its upper end the body member 30 has an annular upper projection 36 located radially inward from the upper end of the annular wall 31 and extending up beyond the top of the annular wall. The upper projection 36 has screw threads 37 on the outside and screw threads 38 on the inside. The lower end of the upper projection 36 is connected to the upper end of the annular wall 31 by an annular horizontal top wall segment 39 formed with several small vertical opensings 40.

The body member 30 has an annular top flange 41 which projects horizontally outward beyond the outside of its annular wall 31 at the latter's upper end. At its upper end the body member 30 presents an upwardly-facing annular recess 42 which is bounded by the top wall segment 39 on the bottom, the screw-threaded outside surface 37 on the upper projection 36 on the inside, and the top flange 41 on the outside. The outer surface 43 of this recess 42 is generally frusto-conical with an upward and outward inclination and it presents an upwardly and inwardly facing annular groove 44 of semi-circular cross-section about midway across its frusto-conical extent.

The top wall segment 39 has an undercut or recess 45 on the top at the laterally outward edge of each vertical opening 40.

The top flange 41 presents a horizontal, flat, annular top face 46 lying in a horizontal plane which is slightly lower than the horizontal, flat, annular top face 47 of the screw-threaded upper segment 36.

Inside its bottom wall segment 34 the body member presents a thin web or membrane 49 of circular outline which is flat for most of its extent. This membrane has an annular peripheral segment 50 of V-shaped cross-section which connects it to the remainder of the body member 30 at the inside of the upper end of the lower projection 34. The bottom of the "V" is a weakened region that can be readily broken for the removal of the web 49 from body member 30.

In one practical embodiment, the external screw threads 33 on the outside of the annular wall extend up about 3 inches or so, the intenal screw threads 38 on the upper segment 36 extend up about 9/16 inch, and the external screw threads 37 on the upper segment 36 extend up about 7/16 inch.

The membrane 55 is a thin, flat, liner of waterproof vinyl-like material and upon insertion is cut with a central circular opening just slightly larger than the screw-threaded exterior 37 of the upper projection 36 on the body member 30. The gasket has several small vertical openings 56 which register individually with the openings 40 in the top of body member 30.

The membrane retainer 60 is generally dish-shaped, with an annular horizontal outside flange 61 at the top, a horizontal annular wall 62 at the bottom with a central opening slightly larger than the threaded outside 37 of the upper projection 36 on body member 30, and a frusto-conical connecting segment 63 which is inclined laterally outward and upward from the bottom wall 62 to the top outside flange 61. Inside this inclinded connecting segment the ring presents a shallow frusto-conical recess 64 above the bottom wall 62. The outside surface 65 of the frusto-conical connecting segment 63 is smaller than the frusto-conical outer surface 43 of groove 42 in body member 30 by the thickness of the membrane 55. The annular bottom wall 62 of the membrane retainer 60 has a plurality of vertical openings 66 which register individually with the membrane openings 56 and the openings 40 in the top of body member 30 to permit the drainage of trapped water.

Figure 8:
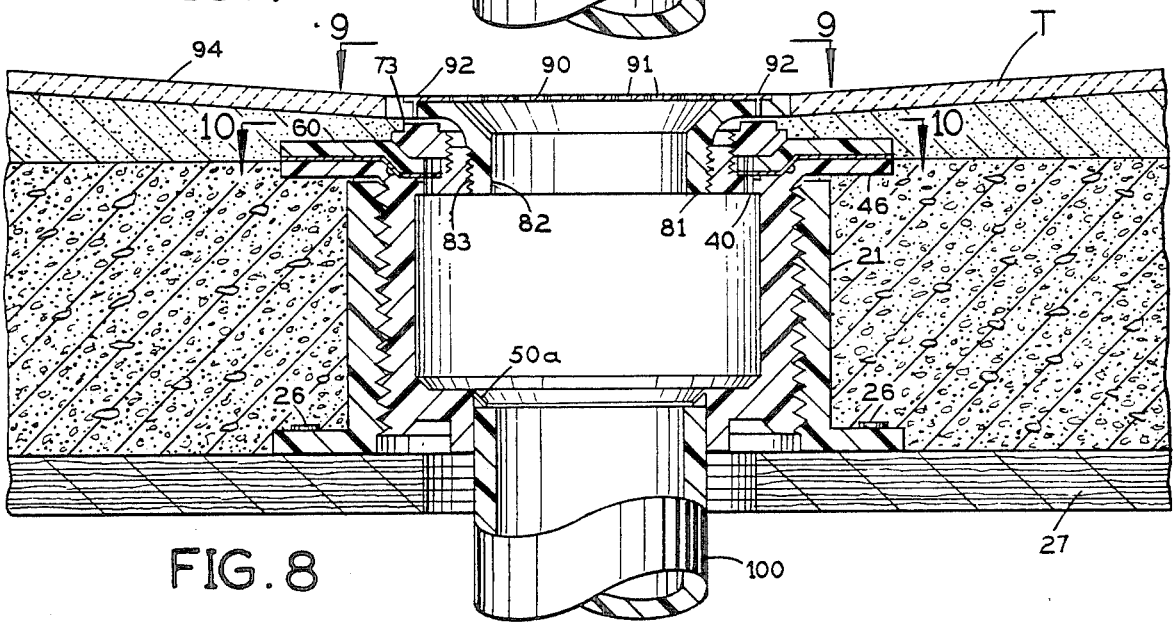
FIG. 8 is a view similar to FIG. 7 after the floor tile is in place and the strainer and its support are in place on the drain.

The clamping ring 70 is internally screw-threaded at 71 for threaded engagement with the outside 37 of the upper projection 36 on body member 30, as shown in FIG. 8. On the outside the clamping ring presents a frusto-conical surface 72 which is complementary to the recess 64 in ring 60. On top the ring has several circumferentially spaced, upwardly projecting lugs 73.

The strainer holder 80 has an annular lower segment 81 with a cylindrical inside surface 82 and a screw-threaded outside surface 83 which is threadedly engageable with the screw threads 38 on the inside of the upper projection 36 on body member 30. Above its cylindrical inside surface 82 the strainer holder presents a frusto-conical surface 84 defining a passageway that is progressively wider upwardly. At the top the strainer holder presents an upwardly-facing, shallow, annular groove 85 bounded by an annular top flange 86. The strainer holder has two or more vertical openings 87 extending down from the bottom surface of groove 85.

Figure 9:
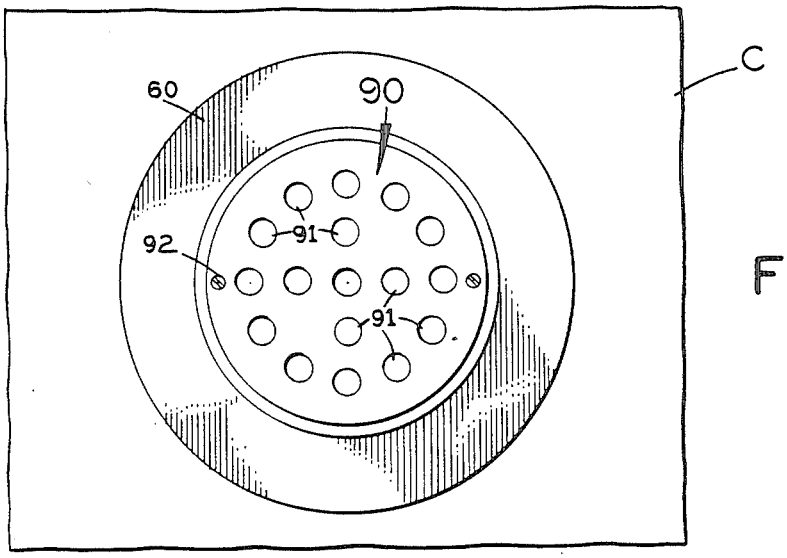
FIG. 9 is a plan view taken along the line 9—9 in FIG. 8.

The strainer plate 90 is relatively thin, flat and circular in outline so that it fits snugly in the groove 85 in the holder. The strainer plate 90 has a multiplicity of openings 91 (FIG. 9) for passing water down into the drain assembly. Screws 92 pass down through openings 93 in the strainer plate which register with corresponding openings 87 in the strainer holder when the strainer plate is seated in the strainer holder groove 85. The screws threadedly engage the strainer holder at the openings 87 to hold the strainer plate 90 in place.

Figure 4:
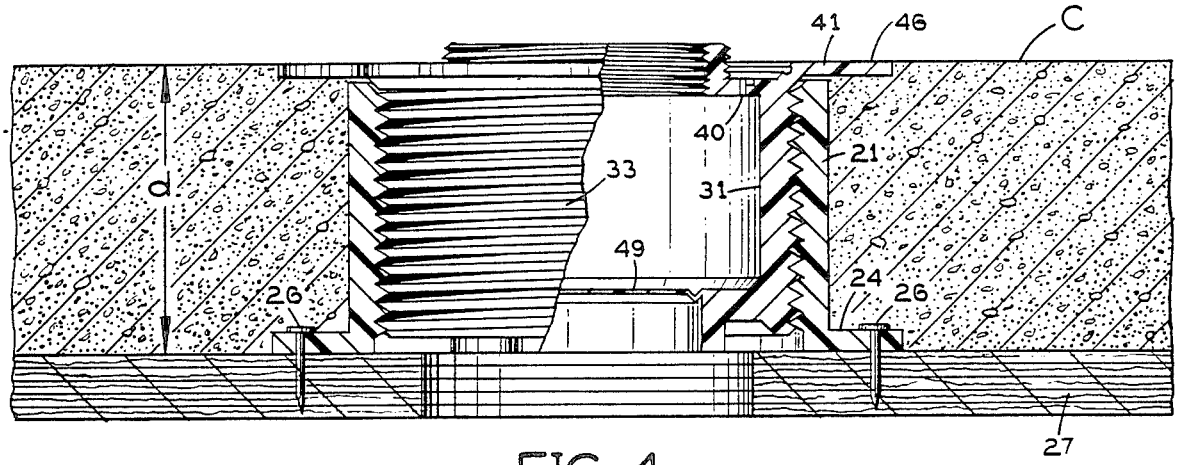
FIG. 4 is a vertical cross-section of the base member of the drain on the form base and the body member of the drain screw-threadedly engaging the base member, with the concrete floor poured to the level of the top of the body member.
Figure 5:
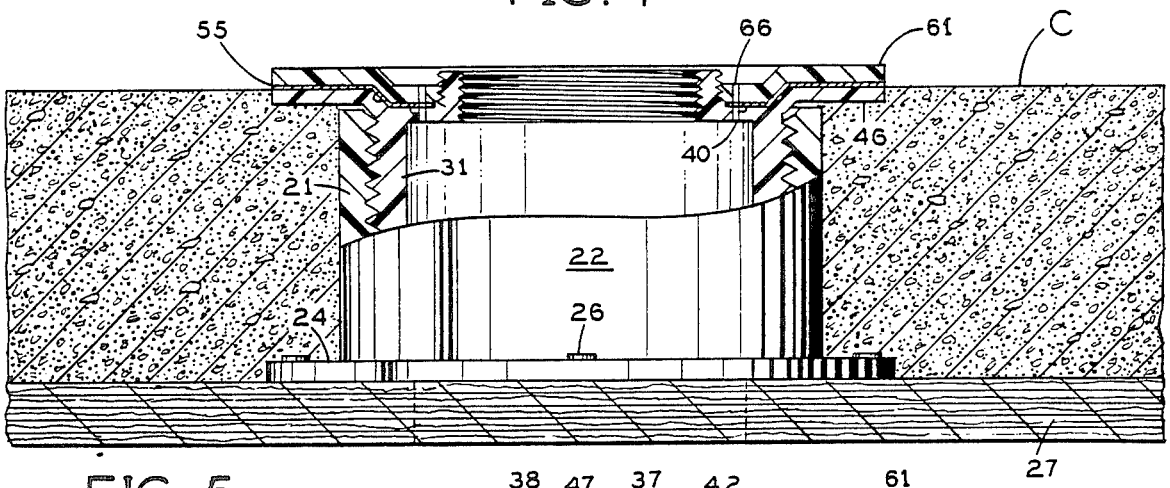
FIG. 5 is a view generally similar to FIG. 4 with the membrane and membrane retainer of the drain in place on top of the body member.

FIGS. 3, 4, 5, 7 and 8 show successive steps in the installation of this drain assembly. The base member 20 is screwed or nailed on top of the plywood form base 27 (FIG. 3). Next (FIG. 4), the body member 30 is screwed down intot he base member 20 in accordance with the desired thickness of the poured concrete floor, which typically may be from 3 to 8 inches. The concrete C is poured onto the plywood form base around the outside of the threadedly assembled base member 20 and body member 30 until the concrete is level with the top surface 46 of the top flange 41 on body member 30, as shown in FIG. 4. The membrane or web 49 on the inside of body member 30 prevents any concrete from getting down past it accidentally, and is useful for purposes of water testing.

Next (FIG. 5) the membrane 55 is placed on top of body member 30. Then the membrane retainer 60 is placed on top of the membrane and pushed down to deform the initially flat membrane into close conformity with the top recess 42 in body member 30. The gasket retainer openings 66 register with the gasket openings 56 and the openings 40 in the top of body member 30.

Figure 6:
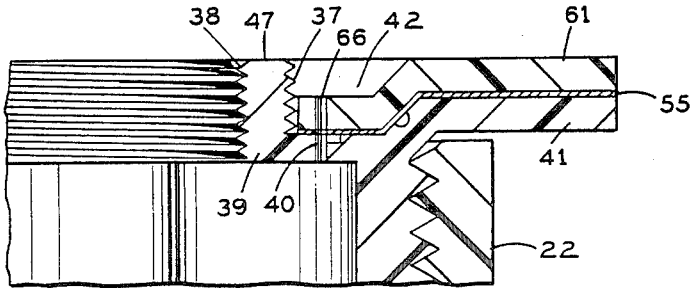
FIG. 6 is an enlarged fragmentary vertical cross-section showing the membrane and membrane retainer on top of the body member.

As shown in FIG. 6, the cylindrical lower projection 34 on the body member 30 may be slidably assembled to a drain pipe 100 which fits snugly inside the projection 34. The flat top end face 101 of the drain pipe engages the bottom of the V-shaped peripheral connecting segment 50 of the protective web or membrane on the inside of body member 30. That is, the connecting segment 50 insures that the body member 30 and the drain pipe are properly positioned with respect to each other during assembly.

Figure 7:
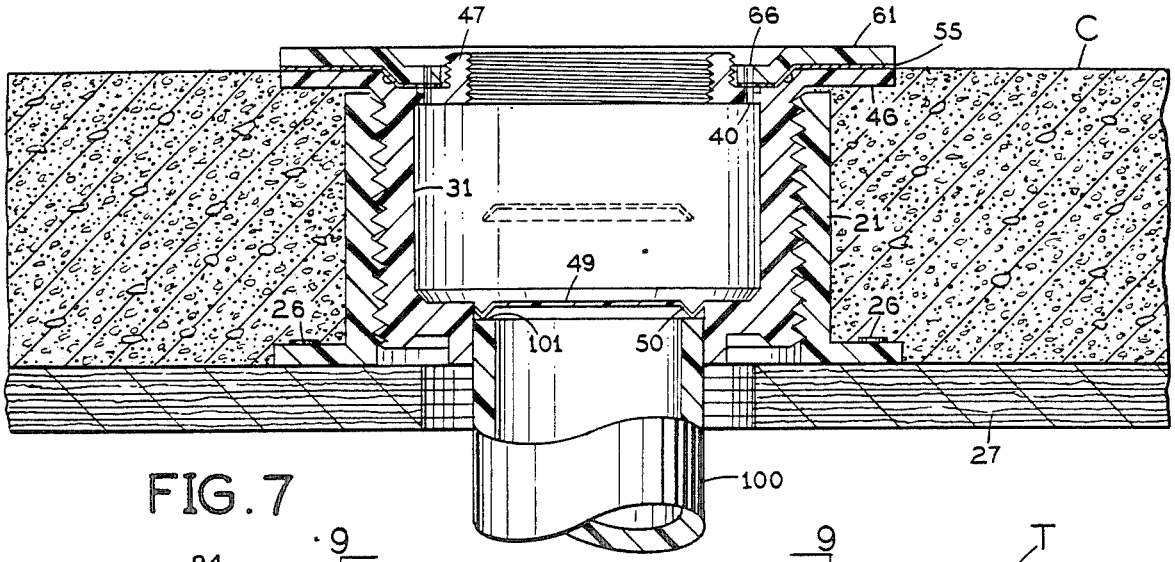
FIG. 7 is a view generally similar to FIG. 5 and showing the drain fited onto the upper end of a drain pipe and a membrane or web inside the drain removed in phantom.

As indicated in phantom in FIG. 7 the protective web or membrane 49 on the inside of body member 30 may be removed now, leaving attached to the body member a downwardly and inwardly inclined annular lip **50*a* (FIG. 8) which was the outer leg of the V-shaped, peripheral, connecting segment 50** of the web before it was severed.

Figure 11:
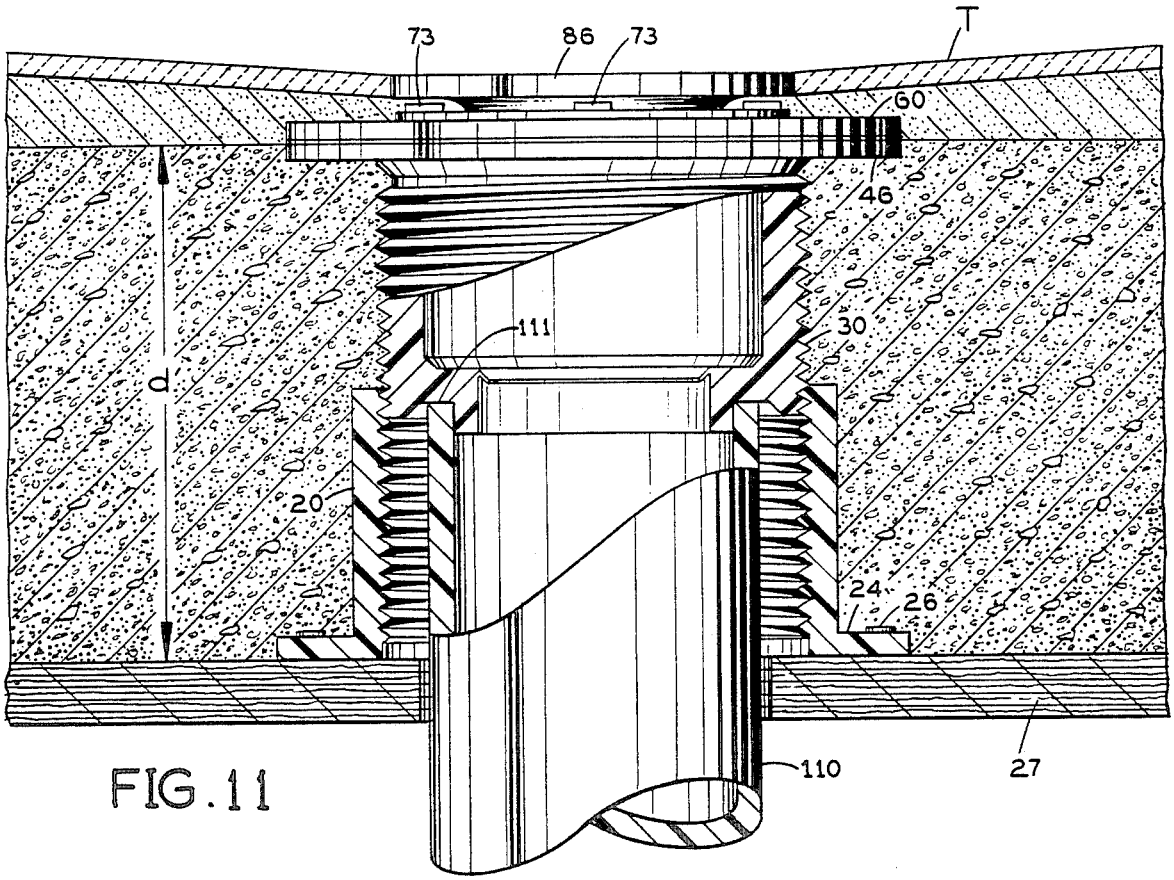
FIG. 11 is a view generally similar to FIG. 8 but with the drain on a larger drain pipe and adjusted vertically to fit a thicker concrete floor.
Figure 10:
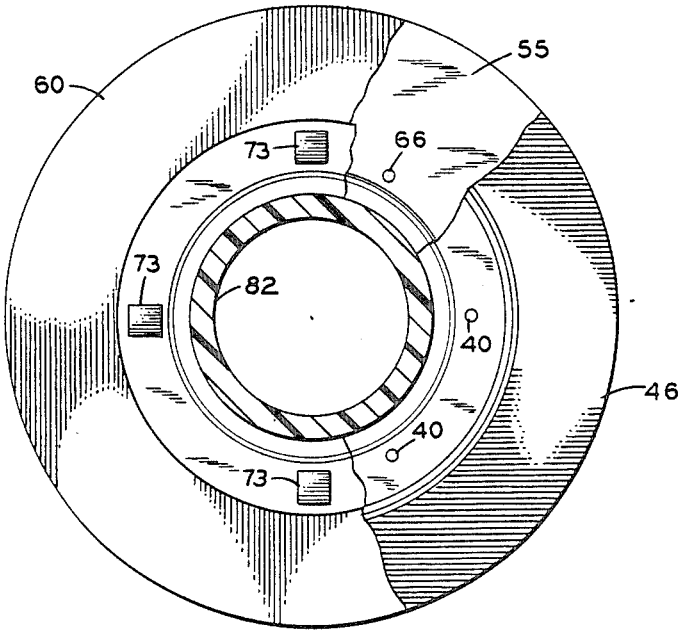
FIG. 10 is a horizontal cross-section taken along the line 10—10 in FIG. 8.

Alternatively, as shown in FIG. 11, the drain pipe 110 may have an inside diameter enabling it to fit snugly but slidably around the outside of the lower projection 34 of body member 30. The drain is assembled to the drain pipe with the top face 111 of the drain pipe abutting against the bottom face of the bottom wall segment of body member 30. The lower projection 34 of the body member is adhesively joined to the inside of drain pipe 110 adjacent the latter's upper end.

After the body member 30 of the drain has been affixed to the drain pipe the clamping ring 70 is screwed down onto the upper projection 36 of body member 30 (FIG. 7) to tighten membrane 55 and membrane holder 60 on top of the body member. The installer may complete the tightening by placing the tip of a screw driver or the like against one of the lugs 73 on the top of ring 70 and striking the opposite end of the screw driver with a hammer to cause the ring to turn the final amount to provide a water-tight seal at membrane 55.

The strainer holder 80 is screwed down into the upper projection 36 of body member and a layer 94 of cement or other suitable tile adhesive is applied over the concrete C and over the top of the membrane retainer 60 and the clamping ring 70 to about the level of the top faces of lugs 73 on top of the ring, as shown in FIG. 8. Tile T or other suitable flooring material is applied over the cement so that the top of the tile immediately next to the drain is at the same level as the top surface of the outer flange 86 on strainer holder 80. The strainer plate 90 is seated in the groove 85 on top of the strainer holder and the screws 92 are inserted to fasten it in place.

FIG. 8 shows the present strainer adjusted for a concrete floor C of minimum thickness, such as about 3 inches. That is, the body member 30 is screwed down as far as it will go into the base member 20.

FIG. 11 shows the strainer adjusted for a concrete floor of maximum thickness, such as about 6 inches. The body member 30 is screwed down into base member 20 the minimum extent sufficient to provide a stable screw-threaded connection between them.

The strainer may be adjusted to match any concrete floor thickness between these two extremes, whether the drain pipe fits inside the drain, as in FIG. 8, or outside the drain, as in FIG. 11.

The strainer holder 80 may be screwed up or down on the body member 30 to position the top of its outer flange 86 flush with the adjacent top surface of the tile T.

The form base 27 may be removed.

I claim:

1. A floor drain for use in a floor of solidified poured material overlying a temporary sub form base comprising:

a base member having a tubular, upstanding, internally screw-threaded tubular segment and a horizontal bottom flange extending laterally outward from said tubular segment for attachment to the form base;

a body member having an externally screw-threaded annular wall which threadedly engages said internally screw-threaded tubular segment of said base member, a smooth-walled cylindrical lower projection extending down below said annular wall at the lower end of said body member, said lower projection having a smaller inside and outside diameter than the inside diameter of said annular wall, an annular upper projection extending up above said annular wall, said upper projection having internal and external screw threads and having a smaller inside and outside diameter than said annular wall, and an annular top flange extending horizontally outward past the upper end of said annular wall;

a deformable annular membrane overlying said top flange and the upper end of said body member laterally outward from said upper projection;

an annular membrane retainer overlying said membrane across and beyond its entire extent;

a ring overlying said membrane retainer for part of its lateral extent, said ring having internal screw threads which threadedly engage said external screw threads on said upper projection of said body member and holding said membrane retainer down to clamp said membrane against the top of said body member;

and an annular strainer holder having an externally screw-threaded lower end segment threadedly engaging said internal screw threads on said upper projection of said body member, said strainer holder having an annular flange on its upper end extending laterally outward beyond its screw-threaded lower end segment and across the top of said ring, said flange on the strainer holder presenting an upwardly-facing annular seat for receiving a perforated strainer.

2. A floor drain according to claim 1 wherein:

said upper end of said body member has small openings therein which communicate with the interior of said body member inside its annular wall;

and said membrane and said membrane retainer have small openings therein which complement said openings in said upper end of the body member.

3. A floor drain according to claim 1 wherein:

said lower projection on the body member is slidably insertable onto a drain pipe having an outside diameter matching the inside diameter of said lower projection;

said lower projection on the body member is slidably insertable onto a drain pipe having an inside diameter matching the outside diameter of said lower projection;

and said body member presents a downwardly-facing horizontal surface encircling said lower projection for engagement with the upper end of a drain pipe having an inside diameter matching the outside diameter of said lower projection.

4. A floor drain according to claim 3 wherein:

said body member has a readily severable web closing the upper end of said lower projection for engagement with the upper end of a drain pipe having an outside diameter matching the inside diameter of said lower projection.

5. A floor drain according to claim 4 wherein:

said web has a peripheral annular lip of generally V-shaped cross-section attaching it to the inside of the upper end of said lower projection.

6. A floor drain for use in a floor of solidified material overlying a form base comprising:

a base member having an upstanding internally screw-threaded segment and attachment means at the lower end of said upstanding segment for attaching the base member to the form base;

a body member having an externally screw-threaded annular wall which threadedly engages said upstanding segment of said base member, an annular lower projection extending down below said annular wall for attachment to a drain pipe, an annular upper projection extending up above said annular wall and having a smaller inside and outside diameter than said annular wall, and an annular top flange extending horizontally outward past the upper end of said annular wall;

a deformable, membrane overlying said top flange and the upper end of said body member laterally outward from said upper projection;

clamping means operatively engaging the outside of said upper projection on said body member for clamping said membrane against the top of said body member;

and an annular strainer holder having a lower end segment operatively engaging the inside of said upper projection on said body member, said strainer holder at its upper end extending across the top of said clamping means, a flange on the strainer holder presenting an upwardly-facing seat for a perforated strainer.

7. A floor drain according to claim 6 wherein said clamping means comprises:

an annular membrane retainer overlying said membrane across substantially its entire extent;

and a ring overlying said membrane retainer for part of its lateral extent and operatively coupled to said upper projection on said body member for vertical adjustment thereon.

8. A floor drain according to claim 7 wherein said ring threadedly engages the outside of said upper projection on said body member.

9. A floor drain according to claim 8 wherein said strainer holder threadedly engages the inside of said upper projection on said body member.

* * * * *